United States Patent [19]

Wells et al.

[11] 4,340,632

[45] Jul. 20, 1982

[54] MANUFACTURE OF FLOCK TRANSFERS

[75] Inventors: Herbert A. Wells, Los Angeles; Walter L. Hochner, San Dimas; George F. Matacek, Costa Mesa, all of Calif.

[73] Assignee: International Coatings Co., Inc., Cerritos, Calif.

[21] Appl. No.: 206,016

[22] Filed: Nov. 12, 1980

[51] Int. Cl.[3] ..... B05D 1/16

[52] U.S. Cl. ..... 428/90; 156/230; 156/234; 156/235; 156/240; 427/148; 427/200; 427/206; 427/272; 427/282; 428/914

[58] Field of Search ..... 427/148, 200, 206, 272, 427/282; 428/90, 914; 156/230, 234, 235, 240

[56] References Cited

U.S. PATENT DOCUMENTS

| | | | |
|---|---|---|---|
| 4,034,134 | 7/1977 | Gregorian et al. | 427/200 |
| 4,048,001 | 9/1977 | Remley | 427/206 X |
| 4,142,929 | 3/1979 | Otomine et al. | 427/200 |
| 4,201,810 | 5/1980 | Higashiguchi | 427/206 X |

FOREIGN PATENT DOCUMENTS 2438749 2/1976 Fed. Rep. of Germany .

*Primary Examiner*—Shrive P. Beck
*Attorney, Agent, or Firm*—William P. Green

[57] ABSTRACT

A transfer is made by a process which includes applying a first adhesive to a base sheet, applying flock fibers to the adhesive for temporary retention thereby on the base sheet, then applying a second layer of adhesive to exposed ends of the flock fibers with the second layer being formed of a composition including an emulsion or solution, preferably an aqueous emulsion, of an adhesive polymer in a carrier liquid together with a large number of minute solid particles of a thermoplastic polymer resin intermixed intimately with the emulsion or solution before application of the composition to the fibers, and with the composition preferably being pressed against the fibers so that upon evaporation of the carrier liquid the second layer remains adhered to the fibers in integrated form with at least some of the particles received between the fibers. The thermoplastic particles are ultimately melted during application of the transfer to an item of clothing or the like, to adhere the flock to that item by the thermoplastic.

24 Claims, 5 Drawing Figures

MANUFACTURE OF FLOCK TRANSFERS

BACKGROUND OF THE INVENTION

This invention relates to transfers for applying a design, printed matter or the like to a fabric or other material, such as for example a shirt or other item of clothing, and more particularly relates to transfers formed to present a flocked surface after application to the item being decorated.

U.S. Pat. No. 4,201,810 discloses a flocked transfer including a base sheet to which flocked fibers are adhered temporarily by a first layer of adhesive, with portions of the fibers projecting away from the sheet and beyond the adhesive, and a second layer of adhesive adhered to those projecting portions of the fibers and formed of a thermoplastic material applied to the fibers in melted form. A powder of a thermoplastic resin adhesive such as polyamide resin, ethylene resin or vinyl chloride resin may be sprayed over the material of the second adhesive layer, and when the second layer and the carried powder are then placed in contact with a fabric and the transfer is pressed thereagainst and heated by an iron or other equipment, the melting of the thermoplastic materials causes adherence of the transfer to the fabric, following which the base sheet may be stripped off leaving the flock fibers exposed. U.S. Pat. No. 4,142,929 describes a similar process in which the second layer of adhesive is formed of a solution or emulsion of a resin, with a heat sensitive adhesive in powdery form being applied to that second layer after the second layer is deposited on the exposed fiber ends, so that upon subsequent heating of the transfer assembly the particles soften to penetrate into a fabric or other item to which the transfer is being adhered.

SUMMARY OF THE INVENTION

A purpose of the present invention is to provide an improved process for manufacture of a flocked transfer in a manner giving the transfer in use a capacity for more effective and more permanent adherence to a garment or the like than is attained by transfers formed in accordance with the above mentioned prior patents. A transfer produced in accordance with the present invention can after application to a garment or other item be washed or dry cleaned repeatedly without adverse effect on the flock design, and without loss of any substantial portion of the flock fibers from the decorated item. The applied transfer can flex freely with the garment or other item to which it is adhered, and normally will not deteriorate from such flexure or from wear any more than the material of the garment itself. In addition to these advantages, a transfer formed in accordance with the invention can be manufactured at extremely low cost and by a very simple and easily automated process resulting in minimization of the cost of the ultimate transfer product.

As in the processes of the above mentioned patents, an initial step in the manufacture of a transfer in accordance with the present invention may be to apply a first layer of adhesive to a base sheet, followed by deposition of flock fibers on the adhesive in a relation temporarily retaining the fibers on the sheet by the adhesive. A second layer of adhesive is then formed by depositing on the fibers a composition including an emulsion or solution of an adhesive polymer in a carrier liquid, together with a large number of minute solid particles of a thermoplastic polymer resin intermixed intimately with the emulsion or solution. Of particular significance is the fact that these particles are premixed into the composition before application of the composition of the fibers, and are not simply sprinkled onto the second layer of adhesive in powder form, after the second layer has been applied, as in the above mentioned prior patents. The carrier liquid is ultimately evaporated from the second layer, leaving the adhesive polymer initially carried by that liquid, and the intermixed particles of solid polymer resin, in a closely integrated form so that when the second layer is heated and pressed against a fabric the melting of the particles will form a highly effective mechanical connection permanently retaining the fibers on the fabric. This connection is enhanced by pressing the composition which forms the second layer against the fibers before evaporation of the carrier liquid to thereby force a portion and preferably substantially all of the thermoplastic particles inwardly beyond the tips or extremities of the fibers and to positions between those fibers so that upon melting of the thermoplastic particles they and the other components of the second layer will adhered to and retain the ends of the fibers with maximum effectiveness.

BRIEF DESCRIPTION OF THE DRAWING

The above and other features and objects of the invention will be better understood from the following detailed description of the typical embodiment illustrated in the accompanying drawing, in which.

DESCRIPTION OF THE PREFERRED EMBODIMENTS

Figure 1:
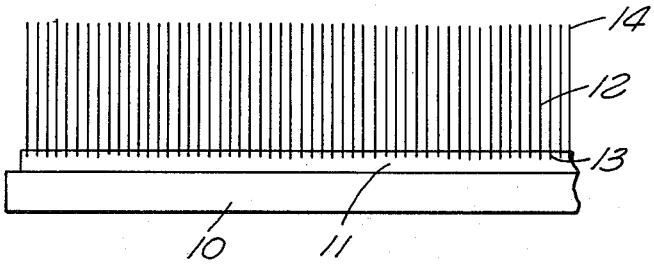
FIG. 1 represents a transfer embodying the invention after a first part of the process of manufacture of the transfer has been completed.

Referring first to FIG. 1, there is represented at 10 a base sheet of paper or other material to which the various components of the transfer are applied and from which the flock is ultimately stripped after adherence to a garment or other item to be decorated. A first step in the present process is to apply to the upper surface of base sheet 10 a layer 11 of a preferably relatively weak adhesive, whose function is to temporarily secure the flock fibers 12 to the base sheet. After the adhesive 11 has been applied to the base sheet, the flock fibers are deposited on the adhesive layer, preferably essentially perpendicular to sheet 10, and with first ends 13 of the fibers contacting and adhered to the adhesive layer 11 and second ends 14 of the fibers projecting upwardly beyond the adhesive. With the fibers in this condition, adhesive layer 11 is cured or dried to hold the fibers as shown.

Figure 2:
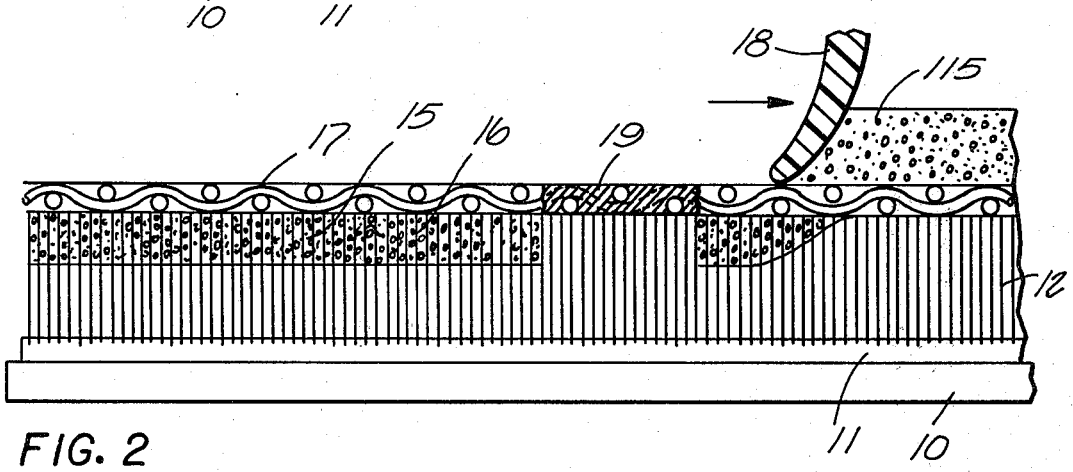
FIG. 2 illustrates application of the second layer of adhesive to the transfer.
Figure 3:
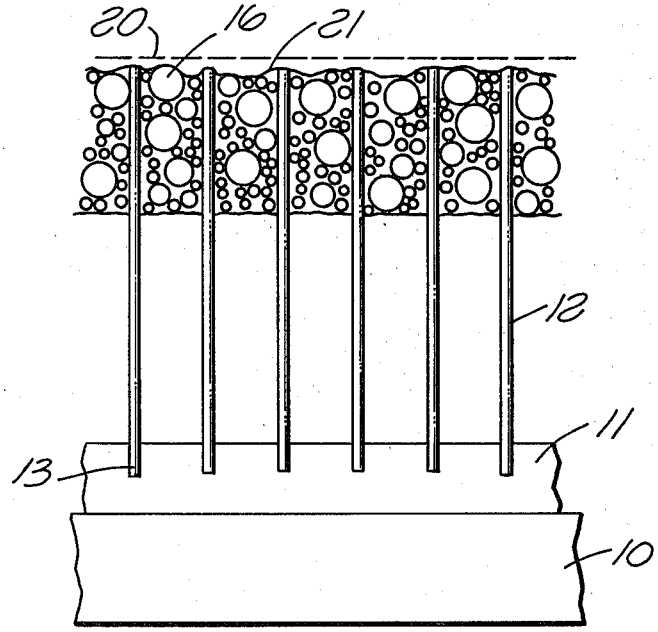
FIG. 3 is an enlarged fragmentary representation of the transfer after curing of the second layer of adhesive.

The next step in the process of manufacture of the transfer is to apply to the upper free ends of the flock fibers 12 a second layer 15 of a different adhesive formed from a composition including an emulsion or solution of an adhesive polymer in a carrier liquid, preferably an aqueous emulsion, and a large number of minute solid particles 16 of a thermoplastic polymer resin intermixed intimately with the adhesive polymer and its carrier liquid. The layer 15 may be deposited on the fibers discontinuously and in any desired pattern, to take the form of any design or arrangement of printed matter which the transfer is intended to depict. The layer 15 is preferably applied in a manner forcing at least part of the composition, and preferably substantially all of the composition which remains on the fibers, to positions downwardly beyond the upper extremities 14 of those fibers and to positions between different ones of the fibers as seen in FIG. 3. This result may be attained by a screen printing process, as represented in FIG. 2, utilizing a screen represented at 17 formed of a loosely woven fabric through which the composition 115 is forced downwardly by a squeegee 18. In FIG. 2, it is assumed that the composition is placed on top of the screen, and that the squeegee is then moved from left to right across the top of the screen in a manner developing a pressure forcing some of the composition downwardly through the screen to a location between the fibers while pushing any excess amount of the composition on top of the screen ahead of the squeegee as shown. Any desired discontinuous pattern may be attained by closing the passages of the screen at different locations, as typically represented at 19 in FIG. 2, so that at those closed areas the composition can not reach the fibers.

After the screen printing operation of FIG. 2, or other appropriate operation or series of operations for applying layer 15 to the upper ends of the fibers, the screen 17 or other equipment utilized in printing layer 15 onto the fibers is removed therefrom, leaving the composition between the upper portions of the fibers, with the liquid in the composition still present. The upper surface of the wet composition at this stage may be aligned or essentially flush with the upper ends 14 of the fibers, as represented by the broken line 20 in FIG. 3. That liquid is then evaporated or driven off, as by passing the assembly through a heated oven for a short period of time, resulting in curing of the adhesive polymer initially carried in the liquid to the condition represented somewhat diagrammatically in FIG. 3. In that figure, the adhesive polymer initially carried in the liquid is represented at 21, and as shown extends essentially entirely about and covers substantially all surfaces of the thermoplastic particles 16 in the composition of layer 15. In particular, it is noted that the adhesive polymer initially carried in solution or emulsion form in the liquid extends across the upper or outer sides of the particles 16 facing away from the carrier sheet 10 as well as across the lower or inner sides facing toward the sheet. Also, the particles 16 and the cured initially liquid carried adhesive polymer 21 are located directly laterally between the end portions of the fibers and form an integrated layer adhered tightly to the fibers and capable of retaining them in the final applied condition of the transfer.

Figure 4:
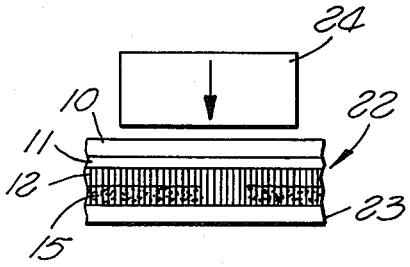
FIG. 4 represents the manner in which the transfer is heated and pressed against a fabric or other material to adhere the transfer thereto.
Figure 5:
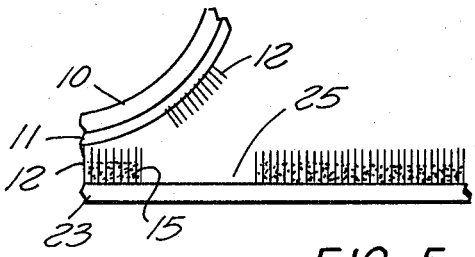
FIG. 5 shows the applied transfer as the base sheet is being stripped therefrom.

The completed transfer assembly is represented fragmentarily and in inverted form at 22 in FIG. 4. When it is desired to apply this transfer to a garment or other item, represented at 23 in FIG. 4, the cured adhesive layer 15 of the transfer is placed against the surface of the garment and an iron or other heated object 24 is placed in contact with base sheet 10 and pressed thereagainst. The heat of the iron melts the thermoplastic material of particles 16 and causes them under the force exerted by iron 24 to penetrate into the pores of the fabric or other material 23. Melting of the thermoplastic material of the particles 16 also enhances the adhesion of those particles to fibers 12 and to the initially liquid carried adhesive polymer 21. Because of the initially intimate intermixture of the particles with the other components of the material forming layer 15, the thermoplastic material of the particles after cooling and hardening remains so intertwined with the other adhesive 21 and in such intimate relationship with the fibers that the mechanical connection resulting from this interfitting relationship of the components supplements and enhances the adhesive characteristics of the materials in layer 15 to assure against subsequent detachment of the fibers from fabric 23. After the transfer has been heated and pressed against item 23 in this manner, the thermoplastic material of particles 16 is allowed to cool, and the base sheet 10 is then stripped away from item 23 as represented in FIG. 5. As the base sheet is stripped from the garment, the fibers retained by layer 15 remain on the garment, while those fibers located at the interruptions formed in layer 15 by the silk screening process are pulled off of the garment by the initial adhesive layer 11. This layer 11 has sufficient adhesion to thus pull off the fibers at the locations at which layer 15 is interrupted, but can be easily stripped from the fibers at the locations at which portions of the stronger and more permanent layer 15 are present, thus forming the desired pattern on the garment.

While we have illustrated in the drawings an arrangement in which the initial adhesive layer 11 and fibers 12 are applied to base sheet 10 over its entire area, it will of course be apparent that layer 11 and fibers 12 may if desired be applied at only certain predetermined locations on the base sheet, and be interrupted at other locations, with layer 15 being interrupted at the same locations. Alternatively, layers 11 and 15 and fibers 12 may all be applied entirely across the area of base sheet 10 to form a continuous flocked transfer in which the uninterrupted layer 15 will adhere continuously to a garment or other item being decorated. This continuous flocked sheet can then be cut to an appropriate pattern if desired, to form letters, numerals, or the like.

To now describe the various components of the illustrated transfer in greater detail, the base sheet 10 may be formed of any material which has sufficient strength and stiffness to carry the other components of the transfer and ultimately be stripped therefrom, and to which the adhesive of layer 11 will adhere lightly, and which will not be adversely affected by the adhesive or by the temperature or other conditions encountered in use. For example, a suitable paper may be utilized, preferably having a calendered finish with closed pores, to be essentially non-absorbent and tightly constructed and have adequate wet strength to maintain its integrity when the composition for forming adhesive layer 11 is applied thereto. Presently preferred is the type of paper referred to as tag stock.

The material of which layer 11 is formed is only very weakly adhesive, to attach the fibers to base sheet 10 only temporarily and allow the base sheet to ultimately be stripped from the fibers as represented in FIG. 5. Any suitably weak adhesive may be employed for the purpose, and may be in solution form or emulsion form. Typical adhesives which may be used are acrylic resins, carboxymethylcellulose, casein, starch, rice-cake powder, vinyl acetate resins and their polymers, vinyl chloride resins and their polymers, polyvinyl alcohol, polyvinyl butyral, polyurethane, polyester, polyamides, cellulose derivatives, rubber derivatives, dextrin, gum arabic, rosin, or mixtures of these various ingredients.

It is presently preferred that the composition for forming layer 11 be a water base emulsion of a resinous polymer, desirably a self cross linking acrylic emulsion. Specific materials usable for the purpose are the self crosslinking water base acrylic emulsions sold by Rohm & Haas Company of Philadelphia, Pa. as Rhoplex HA-8 and Rhoplex E-358, and the water base self-cross linking acrylic emulsion sold by Polyvinyl Chemical Industries of Wilmington, Mass. as Neocryl A-1031. In conjunction with the adhesive polymer, the composition from which layer 11 is formed may include a retarder to prevent drying or plugging of the composition in a printing screen or on rolls or other equipment, with examples of suitable retarders being ethylene glycol monoethyl ether as sold by Union Carbide Corporation of New York, N.Y. under the name Cellosolve, or ethylene glycol monobutyl ether sold by Union Carbide Corporation as butyl Cellosolve or ethylene glycol, propylene glycol or glycerine.

The composition may also include a thickener for providing viscosity and rheology enabling the adhesive formulation to be successfully silk screened or roller coat applied. Any of the known thickeners compatible with the particular adhesive utilized may be employed, such as for example acrylic copolymer emulsion as sold by Rohm & Haas Company under the trade name Acrysol ASE-60, or hydroxyethyl cellulose as sold by Union Carbide Corporation under the name Cellosize QP-15000 or as sold by Hercules Powder Company of Wilmington, Del. under the name Natrosol 250HR. A preservative may also be incorporated in the composition to prevent mold growth or other bacteria action in the aqueous system. Typical preservatives utilizable for the purpose are 1, 2 benzisothiazolin 3-1 as sold by Imperial Chemical Industries of Wlimington, Del. under the name Proxel CRL or tris (hydroxymethyl) nitromethane, as sold by International Minerals & Chemicals Corp, of Des Plaines, Ill. under the trade name Tris Nitro.

When layer 11 is formed from a composition including an aqueous emulsion, the proportions of the various components of the composition are desirably within the following ranges by weight:

| | |
|---|---|
| Water | 72 to 94 percent |
| Adhesive polymer emulsion | 0.5 to 20 percent (solids %) |
| Retarder | 5 to 20 percent |
| Thickener | 1 to 3 percent |
| Preservative | .01 to .1 percent |

The fibers 12 are applied to the composition of layer 11 before drying or curing of that layer. Fibers 12 may be formed of any suitable material, such as rayon, nylon, glass, or other fiber material desired for the particular application. The fibers are preferably all of approximately the same length, desirably between about ten mils and one-fourth of an inch, with a presently preferred length being thirty mils. The fibers are illustrated in the drawing in an idealized orientation, with all of the fibers disposed essentially parallel to one another in closely spaced relation and essentially perpendicular to the base sheet 10 to project upwardly therefrom with their lower ends in contact with and adhered to layer 11. The fibers may be positioned in essentially this manner by electrostatic orientation. In actual practice, however, the idealized relationship illustrated in the drawing can not usually be attained, and normally some of the fibers will be disposed at angles other than directly perpendicular to the base sheet.

After the fibers have been deposited on the wet composition of layer 11, the adhesive of that layer is cured, as by passing the base sheet and the composition of layer 11 and fibers 12 through an oven to raise the temperature of the components to an elevated level for a short period of time, say for example to a temperature of about 250° F. for 30 seconds. This drives off the water of the emulsion and leaves layer 10 as a weak adhesive holding the fibers on the base sheet.

The composition from which the second adhesive layer 15 is formed includes, a previously mentioned, an emulsion or solution of an adhesive polymer in a liquid carrier, preferably a self cross linking water base emulsion, plus the solid thermoplastic particles 16. The self cross linking aqueous acrylic emulsions sold as Rhoplex HA-8 and Rhoplex E-358 by Rohm & Haas Company, or sold as Neocryl A-1031 by Polyvinyl Chemical Industries, may for example be used. The adhesive polymer or polymers in the emulsion should preferably have a solids content constituting between about 10 and 30 percent of the overall composition.

The thermoplastic particles 16 of the composition which forms layer 15 may be any suitable powdered resin having an appropriate melting point to fuse and adhere to a fabric or other material when subjected to the heat and pressure of an iron or other applying unit as illustrated in FIG. 4. For example, the particles 16 may be formed of polyamide resins such as those sold by Emser Industries Inc. of Teaneck, N.J. under the trade names Griltex 1-P-1 and Griltex 1-P-2-3, polyamide copolymers such as those sold by Rilsan Corporation of Glen Rock, N.J. under the designations Platamide H-005 and Platamide M-548, polyester resins such as those sold by Eastman Chemical Products Inc. of Kingsport, Tenn. under the designations FA-250 and FA-300, vinyl chloride, vinyl chloride-vinyl acetate copolymers, polyethylene or polypropylene. The particles 16 may be of any size capable of application by the silk screening or other process employed and also capable of reception between adjacent fibers as illustrated in FIG. 3. Satisfactory for the purpose are ground resins or powders having particle sizes between about 0 and 300 microns. Advantages are attained for some purposes when a mixture of different particle size grades is employed, desirably with a first portion of the particles being within a first relatively small range, and a second portion of the particles being within a substantially larger range, and with relatively few or no particles being within an intermediate range. The small particles may then pack readily within the spaces between different ones of the larger particles in a manner maximizing the overall space occupied by the particles and the manner in which they fit between the fibers. As an example, a highly effective composition occurs when the particles consist of one part thermoplastic particles between 0 and 80 microns in diameter and between 1 and 3 parts of thermoplastic particles having a size between 200 and 300 microns. The presently preferred material for forming the thermoplastic particles is polyamide resin, and the presently preferred melting temperature for that thermoplastic resin is between about 200° and 300° F.

In addition to the polymer emulsion and thermoplastic particles 16, the composition from which adhesive layer 15 is formed also preferably includes a retarder, a thickener, and a preservative, serving the purposes of the corresponding ingredients of the composition of adhesive layer 11. The substances typically referred to as usable for these purposes in adhesive layer 11 may also be employed in the second layer 15, and will not therefore be redescribed in connection with the present discussion of layer 15. It is also contemplated that a pigment may be added to the composition of layer 15, to give that layer a white or colored appearance affording a proper background for the fibers and masking out the color of the underlying fabric to which the transfer is ultimately applied. Any appropriate pigmented ink or dye may be utilized for this purpose. The flock fibers may be colored before application to the layer 11, or may be dyed after application to layer 11, as by a silk screening or other dyeing process.

In the composition from which layer 15 is formed, the principal components may be present in about the following proportions by weight:

| | |
|---|---|
| Water | 15 to 65 percent |
| Adhesive polymer emulsion | 10 to 30 percent (solids %) |
| Thermoplastic particles | 20 to 50 percent |

Other ingredients may be present in the composition as follows:

| | |
|---|---|
| Retarder | 5 to 20 percent |
| Thickener | .1 to 2 percent |
| Preservative | .01 to .1 percent |
| Pigment | 0 to 10 percent |

The curing temperature and period for layer 15 are sufficient to assure evaporation of all of the water from the composition and preferably to also soften slightly the thermoplastic material of particles 16 and thereby attain an initial bond between the particles and the remainder of the composition. For example, the composition of layer 15 if formulated to include one of the above specified acrylic emulsions as the emulsion ingredient may typically be cured for 30 seconds in an oven heated to a temperature of 350° F.

EXAMPLE 1

A flocked transfer was formed by the process illustrated in FIGS. 1 to 3 and described above, utilizing tag stock as sheet 10 and employing the following composition to form layer 11:

| | |
|---|---|
| Water | 86% |
| Acrylic emulsion (Rhoplex E-358-Rohm and Haas) | 1.25% |
| Ethylene glycol monobutyl ether (Butyl Cellosolve-Union Carbide) | 10% |
| Hydroxyethyl cellulose (Cellosize QP-15000) | 2.7% |
| 1,2 benzisothiazolin-3-1 (Proxel CRL) | .05% |

This composition was applied by silk screening to the surface of sheet 10 to a thickness of about 5 mils. Rayon fibers having a length of thirty mils were then applied to the layer 11 by electrostatic orientation, to essentially the condition illustrated in FIG. 1, and the assembly thus formed was then placed in an oven at a temperature of 250° F. for 30 seconds, to drive off the water from the emulsion and cure the adhesive polymer of layer 11.

A composition consisting of the following ingredients was then utilized to form layer 15:

| | |
|---|---|
| water | 34% |
| acrylic emulsion (Rhoplex HA-8-Rohm and Haas) | 21.4% |
| Propylene glycol (retarder) | 8% |
| Polyamide particles-0 to 80 microns (Griltex 1-P-1-Emser Industries) | 12% |
| Polyamide particles 200 to 300 microns (Griltex 1-P-2-3-Emser Industries) | 24% |
| Hydroxyethyl cellulose (Cellosize QP 15000) (thickener) | .5% |
| 1,2 Benzisothiazolin-3-1 (Proxel CRL) (preservative) | .1% |

The ingredients of this composition were all intimately intermixed, and the composition was then applied by silk screening as represented in FIG. 2, with the squeegee 18 acting by movement across the upper surface of the silk screen to force the composition including the particles and the acrylic emulsion downwardly through the screen and into the spaces between the fibers. The silk screen was then removed from the assembly, and the base sheet and carried parts including the upper layer 15 were placed in an oven at a temperature of 350° F. for 15 seconds. This drove off the water of the emulsion and cross linked the acrylic polymer initially contained in the emulsion to result in a dried assembly corresponding to that shown in FIG. 3. This finished transfer was inverted over a sheet of fabric as represented in FIG. 4, and was pressed downwardly against the fabric for 15 seconds by a heated metal plate at a temperature of 375° F. with a pressure of 20 p.s.i. This fused the thermoplastic particles 16 as previously discussed, and after cooling of the thermoplastic material the base sheet 10 and its temporary adhesive 11 were stripped from the flocked fabric 23, with the fibers which were located at the interruptions in the screen printed layer 15 being pulled off with the base sheet. The fabric and applied flocked transfer thus formed were washed repeatedly with no adverse effect on the flock fibers and without separation of the fibers from the fabric.

EXAMPLE 2

The process of Example 1 was repeated utilizing the following composition for layer 10:

| | |
|---|---|
| Water | 85% |
| Acrylic emulsion (Neocryl-A-1031-Polyvinyl Chemical Industries) | 8% |
| Glycerine (retarder) | 5% |
| Hydroxyethyl cellulose (Natrosol 250 HR) (thickener) | 1.95% |
| 1,2 Benzisothiazolin-3-1 (Proxel CRL) | .05% |

and the following composition for the layer 15:

| | |
|---|---|
| Water | 40% |
| Acrylic emulsion (Neocryl A-1031) | 14.5% |
| Glycerine (retarder) | 5% |
| Polyamide particles 60 to 200 microns (Platamide H-005-Rilson Corp.) | 40% |
| Hydroxyethyl cellulose (Natrosol 250 HR) | .4% |
| 1,2 Benzisothiazolin-3-1 | .1% |

Layer 11 was cured at a temperature of 250° F. for 30 seconds, and layer 15 was cured at a temperature of 350° F. for 15 seconds. The resulting transfer was applied to the fabric as in FIG. 4, and adhered effectively thereto through repeated washing and handling.

While certain specific embodiments of the present invention have been disclosed as typical, the invention is of course not limited to these particular forms, but rather is applicable broadly to all such variations as fall within the scope of the appended claims.

We claim:

1. The method that comprises:

applying a first layer of adhesive to a base sheet;

applying flock fibers to said first layer of adhesive for temporary adhesion thereby to said base sheet with portions of the fibers projecting beyond the adhesive layer;

providing a composition which is to be applied to said fibers and which is premixed before application to the fibers and which includes an emulsion or solution of an adhesive polymer in a carrier liquid and a large number of solid particles of thermoplastic polymer resin intermixed intimately with said emulsion or solution;

applying to said projecting portions of the fibers a layer of said composition containing said solid thermoplastic particles premixed into the composition before application of the composition to the fibers; and evaporating the liquid from said composition and leaving said second mentioned layer in integrated form on the fibers.

2. The method as recited in claim 1, in which, during said application of the composition to said fibers, some of said solid thermoplastic particles are positioned between different ones of said fibers before evaporation of the liquid from the composition.

3. The method as recited in claim 1, in which, during said application of said composition to the fibers, the composition is pressed against the fibers in a relation forcing at least some of said emulsion or solution and some of said solid thermoplastic particles to positions between different ones of the fibers.

4. The method as recited in claim 1, in which said composition is applied to said projecting portions of the fibers by a screen printing process in which the composition is pressed against said projecting portions of the fibers in a relation forcing a substantial portion of the composition including a substantial portion of said solid thermoplastic particles to positions between different ones of the fibers.

5. The method as recited in claim 1, including placing said second layer against a surface of a piece of material, applying heat to said base sheet and pressing it toward said surface, thereby melting said thermoplastic particles to adhere said fibers to said surface by the thermoplastic resin of said particles, and stripping said base sheet from the fibers.

6. A transfer formed by the method recited in claim 1.

7. The method that comprises:

applying a first layer of adhesive to a base sheet;

applying flock fibers to said first layer of adhesive for temporary adhesion thereby to said base sheet with portions of the fibers projecting beyond the adhesive layer;

providing a composition which is to be applied to said fibers and which is premixed before application to the fibers and which includes a water based emulsion of an adhesive polymer and a large number of solid particles of thermoplastic polymer resin intermixed intimately with said emulsion;

applying to said projecting portions of the fibers a layer of said composition containing said solid thermoplastic particles premixed into the composition before application of the composition to the fibers; and evaporating the water from said composition and leaving said second mentioned layer in integrated form on the fibers.

8. The method as recited in claim 7, including cross linking of said adhesive polymer in said second mentioned layer when in said integrated form.

9. The method as recited in claim 7, in which said solid thermoplastic particles are formed of a polyamide resin.

10. The method as recited in claim 7, in which said solid thermoplastic particles comprise between about twenty percent and fifty percent of said composition by weight.

11. The method as recited in claim 7, in which said composition contains between about ten percent and thirty percent of said adhesive polymer by weight.

12. The method as recited in claim 7, in which the water and adhesive polymer of said emulsion and said solid thermoplastic particles are present in said composition in about the following relative proportions by weight:

| | |
|---|---|
| Water | 15 to 65% |
| Adhesive polymer | 10 to 30% |
| Thermoplastic particles | 20 to 50% |

13. The method as recited in claim 7, in which said composition includes a retarder, a thickener, and a preservative, with the ingredients being present in about the following proportions by weight:

| | |
|---|---|
| Water | 15 to 65% |
| Retarder | 5 to 20% |
| Adhesive polymer in the emulsion | 10 to 30% |
| Thermoplastic particles | 20 to 50% |
| Thickener | 0.1 to 2% |
| Preservative | 0.01 to 0.1% |

14. The method as recited in claim 13, in which said thermoplastic particles include a first group of relatively small particles between about 0 and 80 microns in size and a second group of larger particles between about 200 and 300 microns in size, with relatively few if any particles between 80 and 200 microns in size.

15. The method as recited in claim 7, in which said particles include a first group of solid thermoplastic particles of relatively large size and a second group of solid thermoplastic particles of relatively small size with few if any particles within an intermediate size range between said large and small sizes.

16. The method as recited in claim 7, including placing said second layer against a surface of a piece of material, applying heat to said base sheet and pressing it toward said surface, thereby melting said thermoplastic particles to adhere said fibers to said surface by the thermoplastic resin of said particles, and stripping said base sheet from the fibers.

17. A transfer formed by the method recited in claim 7.

18. A transfer formed by the method recited in claim 9.

19. A transfer formed by the method recited in claim 12.

20. A transfer formed by the method recited in claim 14.

21. A transfer comprising:

a base sheet;

a first layer of adhesive applied to said base sheet;

flock fibers adhered temporarily to said base sheet by said first layer of adhesive and having portions projecting beyond the adhesive layer;

a second layer of adhesive adhered to said projecting portions of the fibers and including an adhesive polymer adhered to the fibers and a large number of solid particles of a thermoplastic polymer resin intermixed intimately with said adhesive polymer and retained thereby;

a substantial percentage of said particles being located inwardly beyond the extremities of said fibers and laterally between different ones of said fibers.

22. A transfer as recited in claim 21, in which said thermoplastic particles are coated by said adhesive polymer at outer sides of the particles facing away from said base sheet and at inner sides of the particles facing toward the base sheet.

23. A transfer as recited in claim 22, in which said particles are located substantially entirely between said fibers.

24. A transfer as recited in claim 23, in which said particles are formed of a polyamide resin.

* * * * *